US006904711B2

(12) United States Patent
Kim

(10) Patent No.: US 6,904,711 B2
(45) Date of Patent: Jun. 14, 2005

(54) LAMINATION FRAME EMPLOYING PARTIAL HOLOGRAM

(75) Inventor: Jung Hyung Kim, Kyunggi-Do (KR)

(73) Assignee: Kugil Special-Papers Co., Ltd., Kyunggi-Do (KR)

( * ) Notice: Subject to any disclaimer, the term of this patent is extended or adjusted under 35 U.S.C. 154(b) by 47 days.

(21) Appl. No.: 10/348,450

(22) Filed: Jan. 21, 2003

(65) Prior Publication Data

US 2003/0136040 A1 Jul. 24, 2003

(30) Foreign Application Priority Data

Jan. 22, 2002 (KR) ..... 20-2002-0002021

(51) Int. Cl.[7] ..... A47G 1/06; G09F 19/12
(52) U.S. Cl. ..... 40/776; 40/765; 40/615
(58) Field of Search ..... 40/1.5, 1.6, 743, 40/765, 768, 775, 776, 798, 615, 124.01, 654.01, 490, 611.06; 428/35.2; 283/77, 112

(56) References Cited

U.S. PATENT DOCUMENTS 4,231,833 A * 11/1980 Lieberman ..... 156/249
4,940,301 A * 7/1990 Sallai ..... 359/1
4,988,151 A * 1/1991 Moss ..... 359/9
5,401,346 A * 3/1995 Yin et al. ..... 156/233
5,543,010 A * 8/1996 Keng ..... 156/285
5,788,286 A * 8/1998 Hunt ..... 283/117
5,979,096 A * 11/1999 Ferdinandsen et al. ..... 40/768
6,052,933 A * 4/2000 Lytle ..... 40/711
6,058,640 A * 5/2000 Young ..... 40/709
6,701,654 B2 * 3/2004 Rappaport et al. ..... 40/776

* cited by examiner

*Primary Examiner*—Brian K. Green
(74) *Attorney, Agent, or Firm*—Volpe and Koenig, P.C.

(57) ABSTRACT

Disclosed is a laminating frame employing a partial hologram, in which a photograph or picture is placed. The laminating frame includes a first laminating film of a desired dimension; a backing sheet adhered to the first laminating film and having a dimension slightly less than that of the laminating film; a partial hologram film disposed on the backing sheet and having a rim adhered to the first laminating film and a transparent window of a dimension slightly less than that of the backing sheet, wherein the transparent window is patterned with a plurality of dotted-hologram pixels and the rim is patterned on the upper and lower surfaces of the rim with a plurality of deeply colored hologram pixels; and a second laminating film adhered to the partial hologram film.

4 Claims, 7 Drawing Sheets

LAMINATION FRAME EMPLOYING PARTIAL HOLOGRAM

BACKGROUND OF THE INVENTION

1. Field of the Invention

The present invention relates to a laminating frame, and more particularly, to a laminating frame employing a partial hologram capable of carrying a photograph or picture therein.

2. Description of the Related Art

In general, a hologram is used to record an interference pattern of light, such as laser beam, on a recording medium such as a film or a photosensitive dry plate. Also, a hologram is used to reproduce a 3-dimensional image of an object. For example, in case of recording the face of a person, the shape of the recorded person may vary depending upon the viewing position. In other words, in case of a hologram showing the face of a person, frontal and side perspective views may be seen depending upon the viewing position.

Even though a hologram film patterned with a plurality of hologram pixels does not represent a 3-dimensional image of the object, the hologram film shines on the periphery of the object, thereby producing a brilliant and realistic image.

Up to now, picture and photograph are generally put and kept in an album, a transparent film or a frame. Besides the photograph itself, realistic images and feelings may not be expressed, for example, a mysterious image in which the figure of a person rises from dark space with an infinite number of stars twinkling.

Furthermore, although a person may attempt to decorate a cabinet or desk by putting a photograph or picture of a person on a flat surface thereof, the photography or picture will not properly match with the decorative surroundings, because the photograph or picture is simply coated with a transparent film.

SUMMARY OF THE INVENTION

Accordingly, the present invention is directed to a laminating frame that substantially obviates one or more problems due to limitations and disadvantages of the related art.

It is an object of the present invention to provide a laminating frame employing a partial hologram, in which a photograph or picture of a person such as a sweetheart, a family member, a friend and so forth may be placed and carried in the laminating frame. The laminating frame may stand against an article disposed on a cabinet or desk and the photograph or picture may be easily carried by a user.

Another object of the present invention is to provide a laminating frame containing a photograph or picture, which can be used to decorate a room, office or the like.

To achieve these objects and other advantages and in accordance with the purpose of the invention, as embodied and broadly described herein, a laminating frame employing a partial hologram is provided, in which a photograph or picture is placed. The laminating frame comprises: a first laminating film of a desired dimension; a backing sheet adhered to the first laminating film and having a dimension slightly less than that of the laminating film; a partial hologram film disposed on the backing sheet and having a rim adhered to the first laminating film and a transparent window of a dimension slightly less than that of the backing sheet, wherein the transparent window is patterned with a plurality of dotted-hologram pixels and the rim is patterned on the upper and lower surfaces of the rim with a plurality of deeply colored hologram pixels; and a second laminating film adhered to the partial hologram film.

A space is provided between the lower layer consisting of the first laminating film and the backing sheet and the upper layer consisting of the partial hologram film and the second laminating film, so as to accommodate the photograph or picture. The lower layer has an opening portion to be torn off along one edge of the backing sheet such that the photograph or picture is placed or replaced therein.

According to another aspect of the present invention, a laminating frame employing a partial hologram is provided, in which a photograph or picture is placed. The laminating frame comprises: a first laminating film of a desired dimension; a backing sheet disposed on one side of the first laminating film; a partial hologram film disposed on the other side of the first laminating film in such a manner that a desired spacing is provided between the backing sheet and the partial hologram film; and a second laminating film disposed on the backing sheet and the partial hologram film, wherein one portion of the respective first and second laminating films, which respectively encloses the upper and lower surfaces of the partial hologram film, is bent toward the other portion of the respective first and second laminating films, which respectively encloses the upper and lower surfaces of the backing sheet, such that a desired space is formed between the one portion and the other portion, and the first laminating film enclosing one side of the backing sheet is provided on the upper edge of the first laminating film with an opening portion formed at the first laminating film and the backing sheet.

The first laminating film is provided on the upper center edge of the first laminating film with a hanging hole.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, an example of which is illustrated in the accompanying drawings.

Figure 1:
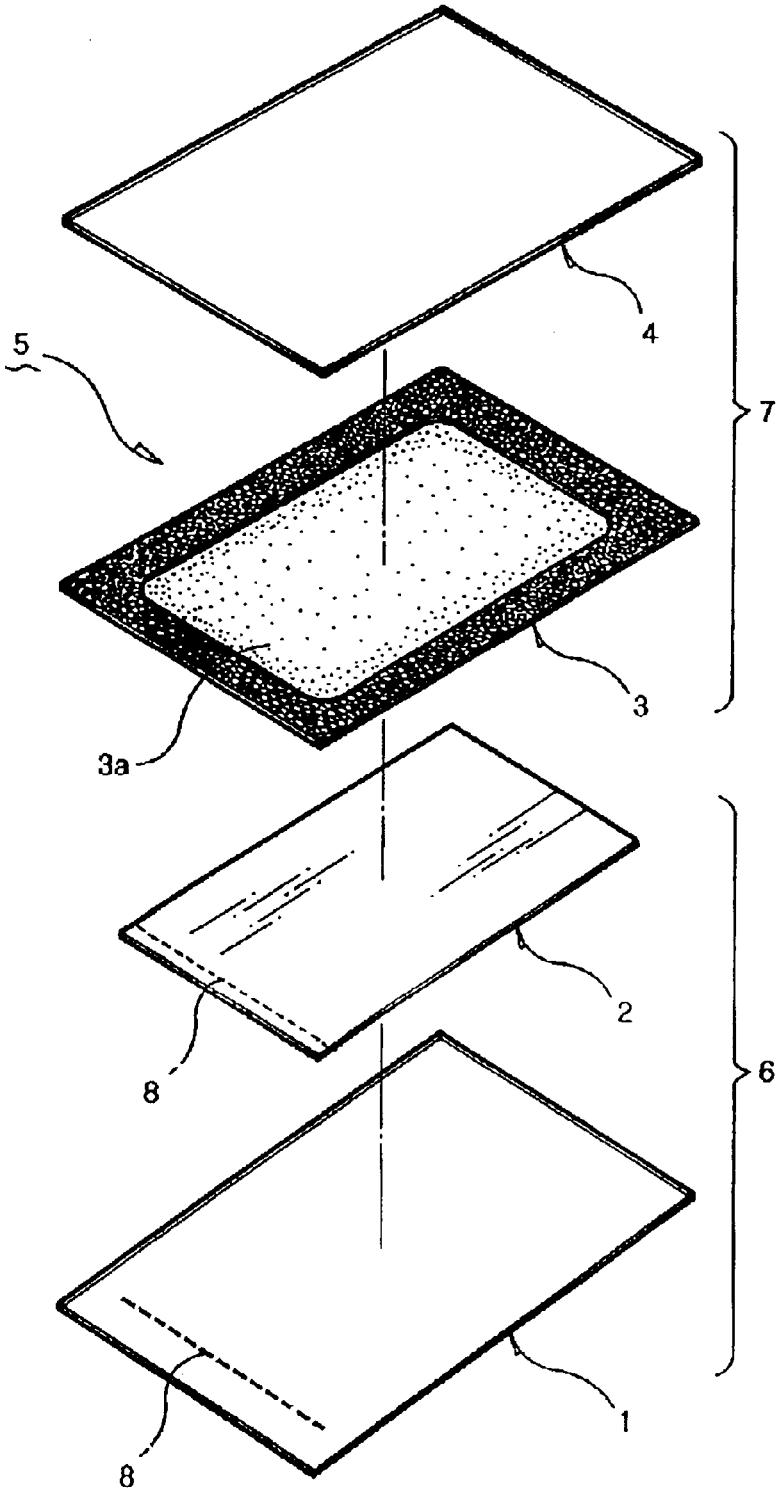
FIG. 1 is an exploded perspective view illustrating a laminating frame employing a partial hologram of the present invention.

FIG. 1 is an exploded perspective view illustrating a laminating frame employing a partial hologram according to the present invention.

Figure 2:
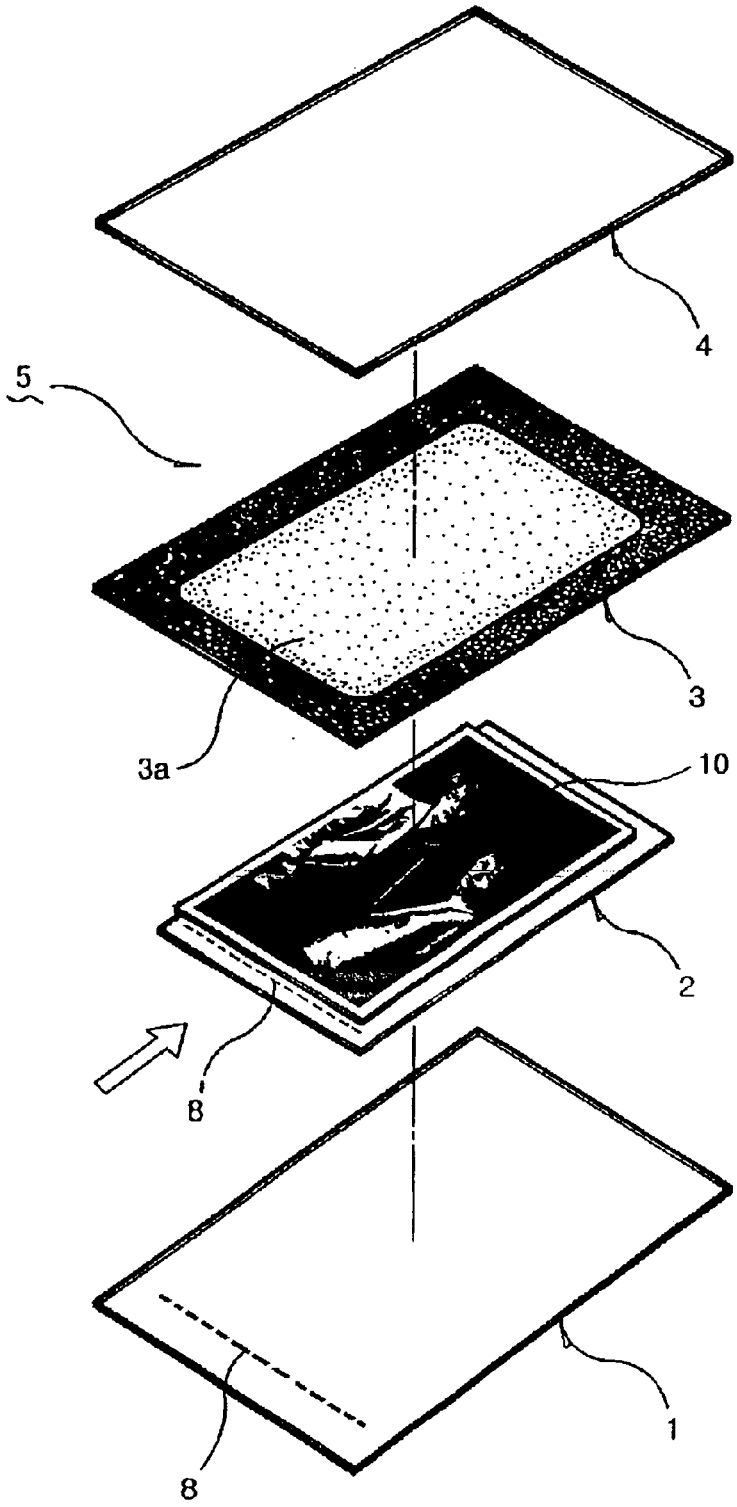
FIG. 2 is an exploded perspective view illustrating the structure of which a laminating frame employing a partial hologram of the present invention accommodates a photograph.

FIG. 2 is an exploded perspective view illustrating the state of a photograph disposed in a laminating frame employing a partial hologram according to the present invention.

The laminating frame of the present invention includes a first laminating film 1 of a desired dimension; a backing sheet 2 adhered to the first laminating film and having a dimension slightly less than that of the laminating film; a partial hologram film 3 disposed on the backing sheet and having a rim adhered to the first laminating film and a transparent window 3*a* of a dimension slightly less than that of the backing sheet; and a second laminating film 4 adhered to the partial hologram film, wherein the transparent window is patterned with a plurality of dotted-hologram pixels and the rim is patterned on the upper and lower surfaces of the rim with a plurality of deeply colored hologram pixels, The partial hologram film 3 may provide a glittering effect to the peripheries of the front and rear rims of a laminating frame 5 of the present invention, while a mysterious image in which the figure of a person rising from a dark space with an infinite number of stars twinkling may reappear in the transparent window 3*a*.

A space is provided between the lower layer 6 consisting of the first laminating film and the backing sheet and the upper layer 7 consisting of the partial hologram film and the second laminating film, so as to accommodate the photograph or picture. The lower layer has an opening portion 8 to be torn off along one edge of the backing sheet 2 such that the photograph or picture may be placed therein or replaced therein.

Meanwhile, as shown in FIGS. 5 to 8, a laminating frame 5' according to an alternative embodiment of the present invention includes: a first laminating film 1' of a desired dimension; a backing sheet 2' disposed on one side of the first laminating film; a partial hologram film 3' disposed on the other side of the first laminating film in such a manner that a desired spacing is provided between the backing sheet and the partial hologram film; and a second laminating film 4' disposed on the backing sheet 2' and the partial hologram film 3'.

One portion of the respective first and second laminating films 1' and 4', which respectively encloses the upper and lower surfaces of the partial hologram film 3', is bent toward the other portion of the respective first and second laminating films 1' and 4', which respectively encloses the upper and lower surfaces of the backing sheet 2' such that a desired space is formed between the one portion and the other portion. The first laminating film 1' enclosing one side of the backing sheet 2' is provided on the upper edge of the first laminating film with an opening portion 8' formed at the first laminating film 1' and the backing sheet 2'.

The first laminating film 1' is provided with a hanging hole 9 on the upper center edge of the first laminating film. The partial hologram film 3' includes a transparent window 3*a'* on which a plurality of dotted-hologram pixels are printed.

Preferably, the first laminating films 1 and 1', the partial hologram films 3 and 3' and the second laminating films 4 and 4' are made of a polyester resin, in particular, polyethylene terephthalate (PET).

Preferably, the backing sheets 2 and 2' are made of a paper or film.

A method of manufacturing the laminating frame employing the partial hologram according to the present invention will now be described.

First of all, the first laminating film 1 of a desired dimension is larger than that of the photograph or picture. The backing sheet 2 is disposed on the first laminating film and is then adhered to the first laminating film (referring to FIG. 1).

The partial hologram film 3, which has a rim with a plurality of deeply colored hologram pixels and a rectangular transparent window 3*a* provided within the rim, is disposed on the first laminating film 1 with the backing sheet 2 interleaved therebetween. After the second laminating film 4 is arranged on the partial hologram film, the first and second laminating films 1 and 4 are pressed and adhered closely to the partial hologram film 3 by means of a heat press (not shown).

At that time, the lower layer 6 consisting of the first laminating film and the backing sheet is separated from the upper layer 7 consisting of the partial hologram film and the second laminating film, so as to accommodate the photograph or picture (referring to FIG. 2).

A portion of the lower layer 6 is cut along the lower layer 6 by means of the rim of the backing sheet 2.

Figure 3:
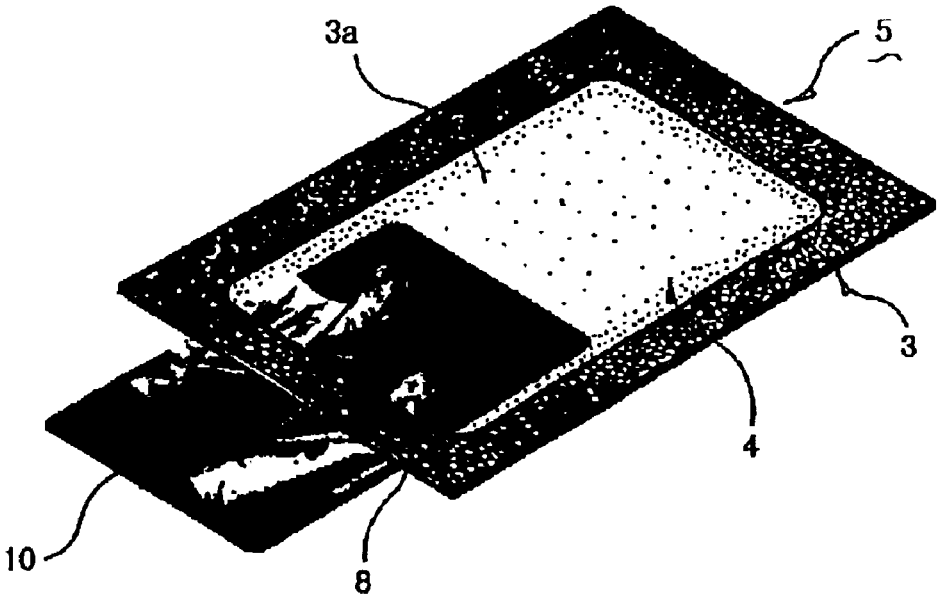
FIGS. 3 and 4 are perspective views illustrating the structure of which a laminating frame employing a partial hologram of the present invention accommodates a photograph.
Figure 4:
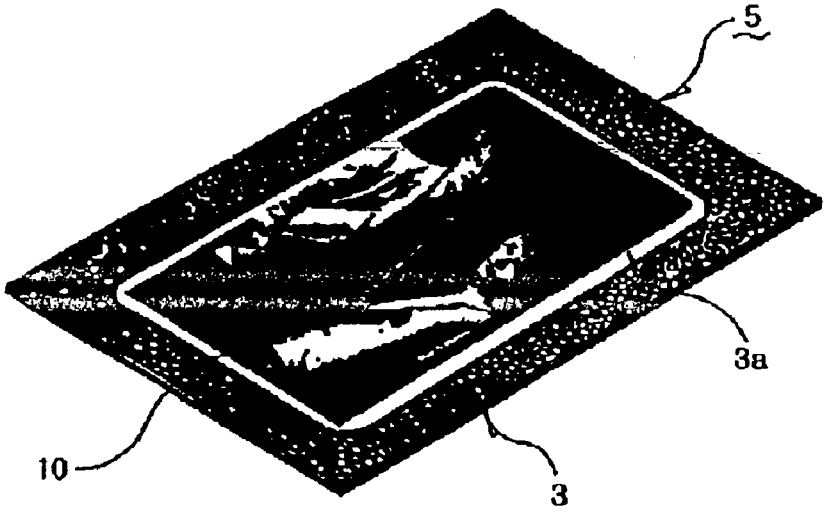

Specifically, in case of turning over the laminating frame 5, the lower layer 6 (i.e., the first laminating film 1 and the backing sheet 2) is cut by means of a cutter, thereby forming the opening portion 8 of a desired dimension (referring to FIGS. 2 and 3).

Even though the partial hologram film 3 is partially cut by means of a cutter, the laminating frames are easily formed, since the second laminating film 4 made of rigid material is adhered to the rear side of the partial hologram film.

When the photograph or picture is placed in the laminating frame 5, the photograph or picture is inserted into the opening portion 8 formed between the lower layer 6 and the upper layer 7 in such a manner that the picture of the photograph 10 faces the partial hologram film 3.

Another method of manufacturing the laminating frame according to an alternative embodiment of the present invention will now be described with reference to FIGS. 5 to 8.

Figure 5:
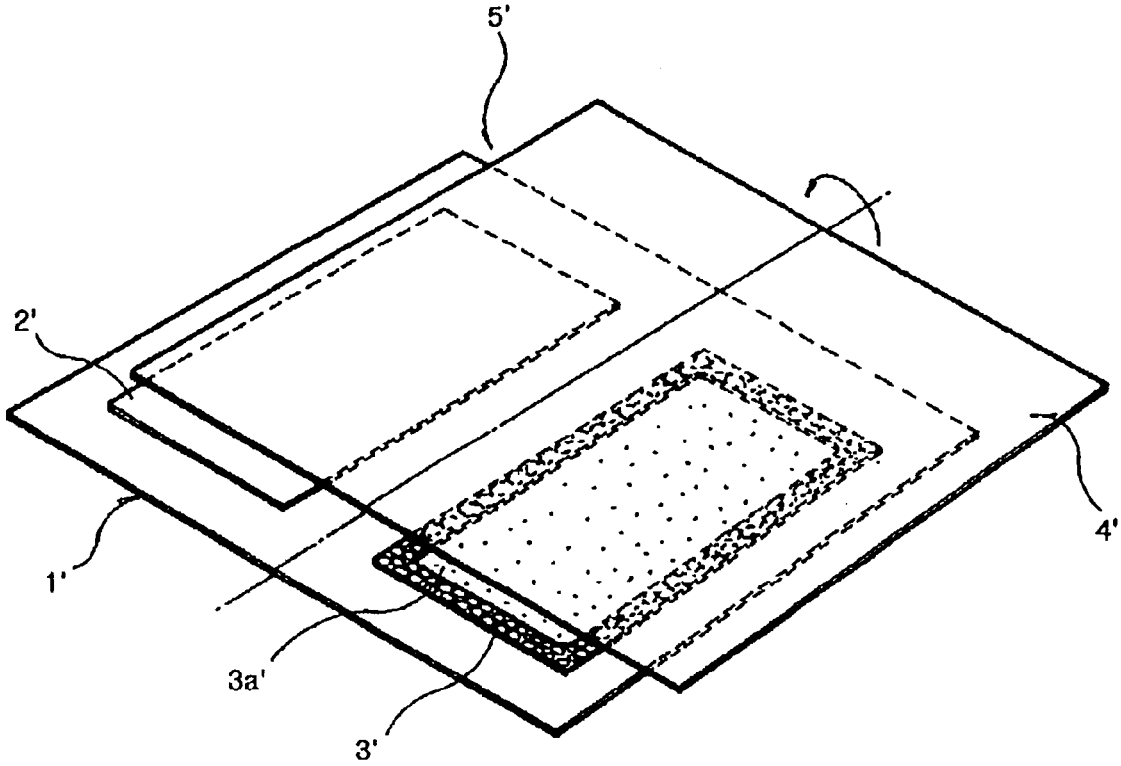
FIG. 5 is a perspective view illustrating an initial process of manufacturing an alternative laminating frame employing a partial hologram of the present invention.
Figure 6:
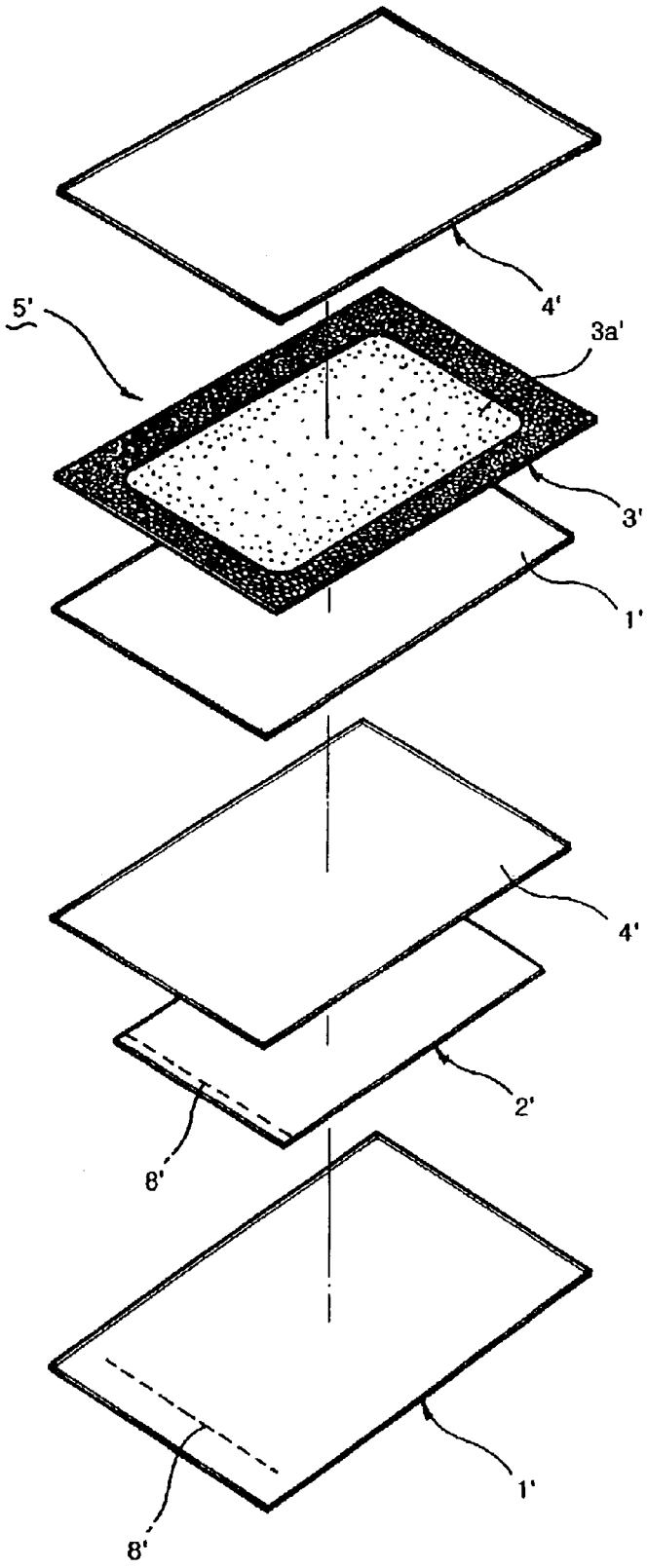
FIGS. 6 and 7 are exploded perspective views illustrating the alternative laminating frame employing a partial hologram of the present invention shown in FIG. 5.
Figure 7:
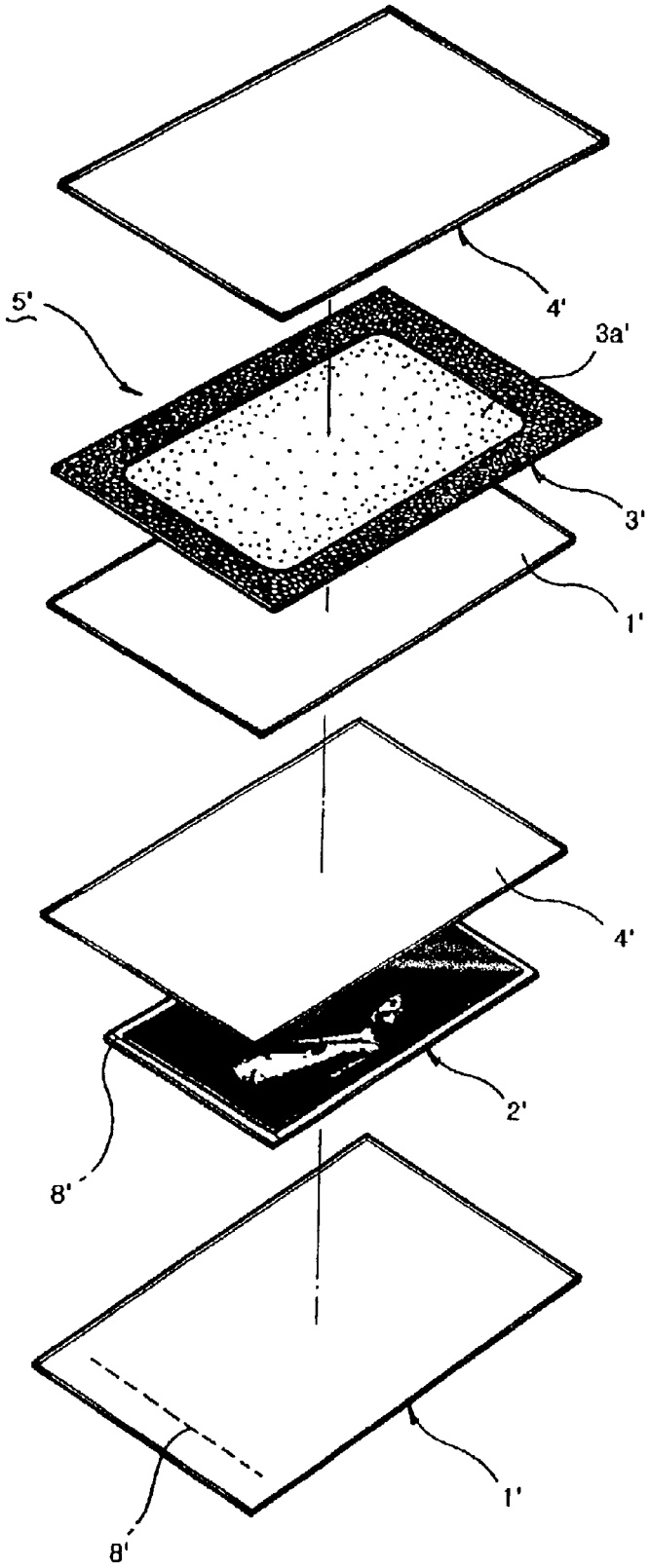

First of all, as shown in FIG. 5, after the first laminating film 1' is prepared, the backing sheet 2' is disposed on one side of the first laminating film, while the partial hologram film 3' is disposed on the other side of the first laminating film. The second laminating film 4' is disposed on the backing sheet 2' and the partial hologram film 3' so as to cover the entire surfaces of the backing sheet and partial hologram film.

After the rims of the first laminating film 1' and the second laminating film 4', which correspond to the backing sheet 2' and the first laminating film 1', and the second laminating film 4', which corresponds to the partial hologram film 3', are respectively adhered by means of a heat press (not shown), the first and second laminating films 1' and 4' are simultaneously cut to a predetermined dimension to encompass the backing sheet 2' and the partial hologram film 3' in full.

In the state of turning over the first and second laminating films 1' and 4', the upper rims of the first laminating film 1' and backing sheet 2' are cut by means of a cutter to form the opening portion 8' for accommodating the photograph or picture.

At that time, the lower portion of the backing sheet 2' is adhered to the first laminating film 4', while the upper portion of the backing sheet is separated from the second laminating film 4'.

The first and second laminating films 1' and 4' covering the partial hologram film 3' are bent along an imaginary axis between the sticking backing sheet 2' and the partial hologram film 3'.

The left rim of the first laminating film 1' and the right rim of the second laminating film 4' are then adhered to each other by means of a heat press (not shown).

Figure 8:
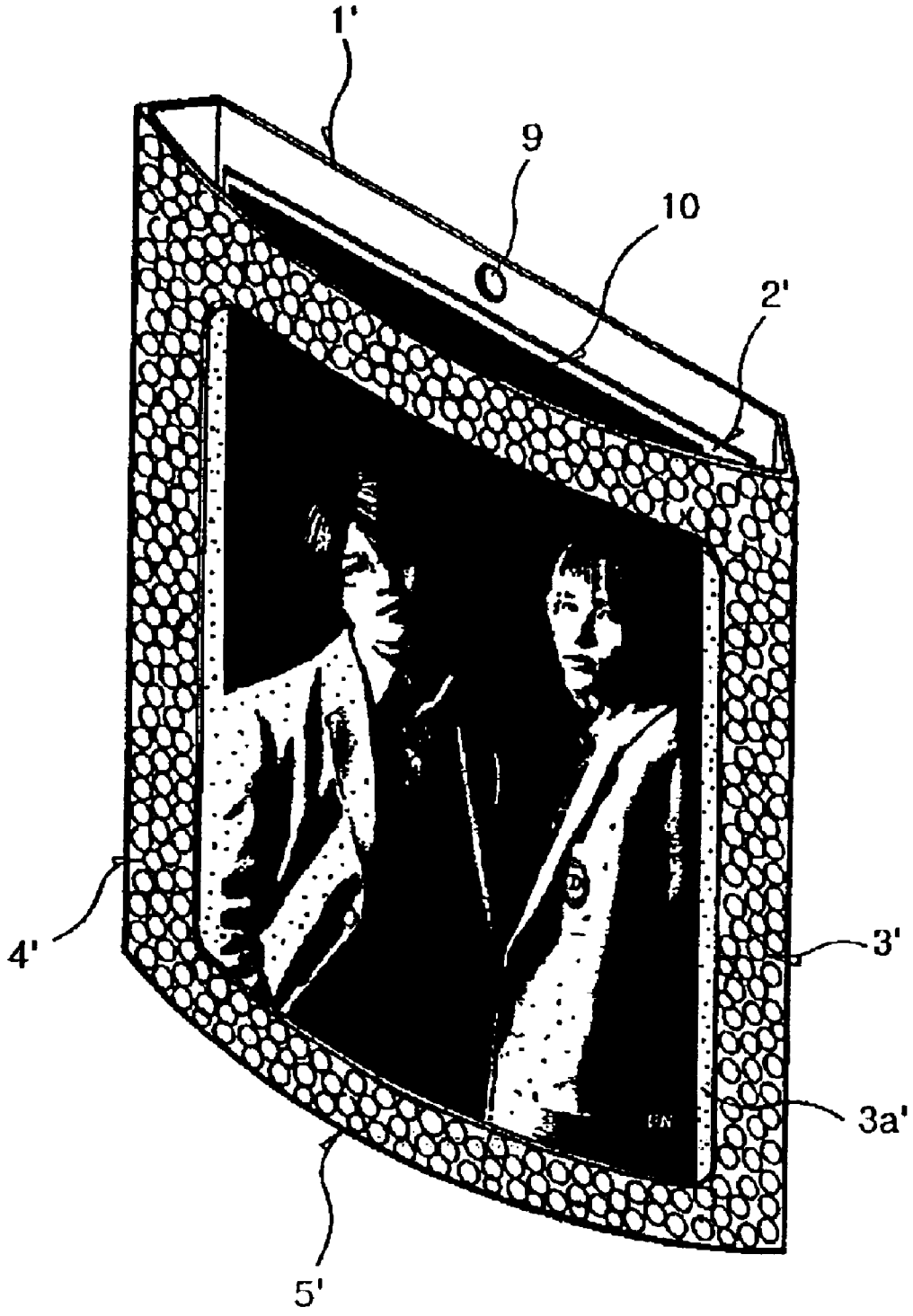
FIG. 8 is a perspective view illustrating the structure of the laminating frame shown in FIGS. 6 and 7.

As shown in FIG. 8, the laminating frame 5' has a gap of a desired dimension between the backing sheet 2' and the partial hologram film 3' (i.e., between folded second laminating film 4'), so that the laminating film may be disposed on a flat surface of a cabinet or table in an upright position.

Meanwhile, the upper center portion of the opening portion 8' facing the backing sheet 2' is provided with a hanging hole 9 so as to hang the frame 5' on the hook of a wall.

With the above laminating frame of the present invention, the photograph or picture of a person such as a sweetheart, a family member, a friend and so forth may be inserted and kept in the frame consisting of the partial hologram film and the laminating film, thereby producing a mysterious image. In addition, the photograph or picture may be easily carried by a user.

A room, office or the like may be decorated with the laminating frame carrying the photograph or picture.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A laminating frame in which a photograph or picture is placed, the laminating frame comprising:

a first laminating film of a desired dimension;

a backing sheet adhered to the first laminating film and having a dimension slightly less than that of the first laminating film;

a partial hologram film disposed on the backing sheet and having a rim adhered to the first laminating film and a transparent window of a dimension slightly less than that of the backing sheet, wherein the transparent window is patterned with a plurality of dotted-hologram pixels and the rim is patterned with a plurality of deeply colored hologram pixels on upper and lower surfaces of the rim; and a second laminating film adhered to the partial hologram film.

2. The laminating frame in claim 1, wherein a space is provided between a lower layer consisting of the first laminating film and the backing sheet and an upper layer consisting of the partial hologram film and the second laminating film, so as to accommodate the photograph or picture, and the lower layer has an opening portion to be torn off along one edge of the backing sheet such that the photograph or picture is placed in or replaced from the space therein.

3. The laminating frame in claim 1, wherein the backing sheet is made of paper.

4. The laminating frame in claim 1, wherein the backing sheet is made of a film.

* * * * *